United States Patent [19]

Gamble et al.

[11] 4,348,176

[45] Sep. 7, 1982

[54] MATERIAL HANDLING APPARATUS FOR INSULATORS

[75] Inventors: James R. Gamble, Greensburg; Lear C. Herrold, Derry; Rowland S. Baran, Latrobe, all of Pa.

[73] Assignee: Westinghouse Electric Corp., Pittsburgh, Pa.

[21] Appl. No.: 212,283

[22] Filed: Dec. 2, 1980

[51] Int. Cl.[3] ..... F27D 5/00

[52] U.S. Cl. ..... 432/258; 432/261

[58] Field of Search ..... 432/258, 259, 260, 261

[56] References Cited

U.S. PATENT DOCUMENTS

| | | | |
|---|---|---|---|
| 1,186,490 | 6/1916 | Moorcroft | 432/258 |
| 1,832,442 | 11/1931 | Anderson | 432/258 |
| 3,778,224 | 12/1973 | Duffner | 432/258 |
| 4,184,840 | 1/1980 | Gamberg et al. | 432/258 |

*Primary Examiner*—John J. Camby

*Attorney, Agent, or Firm*—J. P. Hillman

[57] ABSTRACT

Apparatus for supporting an insulator or a plurality of insulators having a support means for supporting the insulators at a predetermined position and an integral spacing means integrally connected to the support means for supporting another support means to provide for stacking of a plurality of apparatus. The support means includes a base having a plurality of recesses therein for receiving a mounting portion of a typical insulator and supporting it in a predetermined position. The spacing means includes integral supports projecting upward a predetermined distance from the periphery of the base and an external peripheral wall enclosed upon itself extending upward a second predetermined distance from the periphery of the base, the first and second predetermined distances being selected to provide for adequate ventilation of the insulators. Being self-supporting the apparatus eliminates secondary support materials that are normally required.

11 Claims, 4 Drawing Figures

MATERIAL HANDLING APPARATUS FOR INSULATORS

BACKGROUND OF THE INVENTION

The invention relates in general to apparatus for supporting and transporting insulators and more particularly to apparatus having integral support means for supporting insulators.

DESCRIPTION OF THE PRIOR ART

A large amount of handling is required in the production of ceramic insulators. The insulators must be supported and transported from the forming of the greenware through glazing, firing and finally final inspection prior to shipment. First the greenware must be supported, usually on the bottom portion of the mounting flange, while it is passing through the glazing operation, then it must be supported, usually by stacking, within a kiln wherein care must be taken that the insulator has proper ventilation during the firing operation, and finally the fired insulator is transported from the kiln to the final inspection area prior to packaging for shipment. Proper ventilation for the firing operation is usually achieved by supporting the insulator greenware in recesses on a flat plate and then stacking the plates one upon the other separated by refractory fire brick. This requires the labor-consuming stacking of the alternate plates and fire brick within the kiln and then unstacking the same for transportation of the fired insulators to the inspection area. Accordingly, it would be desirable to have a material handling apparatus for ceramic insulators (both greenware and fired insulators) having integral support and spacing means that would provide sufficient ventilation for the firing operation as well as provide for ease of stacking and transporting such that individual handling of the ceramic insulator containers before or after firing is not necessary.

SUMMARY OF THE INVENTION

Briefly, the present invention is a reusable support apparatus or material handling device for insulators that combines a support means with an integral spacing means to provide apparatus that may be stacked (or unstacked) one upon the other and transported throughout the various production areas of a typical manufacturing facility without disturbing the individual insulators supported thereon. Secondary support materials usually required for stacking in the kiln during firing are eliminated. The support means includes a base having at least one and most likely a plurality of recesses therein for receiving and supporting the mounting portion of an insulator and integral spacing means including integral supports projecting upward from the periphery of the base to provide for stacking of multiple apparatus without interfering with the insulators.

BRIEF DESCRIPTION OF THE DRAWINGS

The invention may be understood and further advantages and uses thereof more readily appreciated when considered in view of the following detailed description of exemplary embodiments, taken with the accompanying drawings, in which.

DESCRIPTION OF THE PREFERRED EMBODIMENTS

Figure 1:
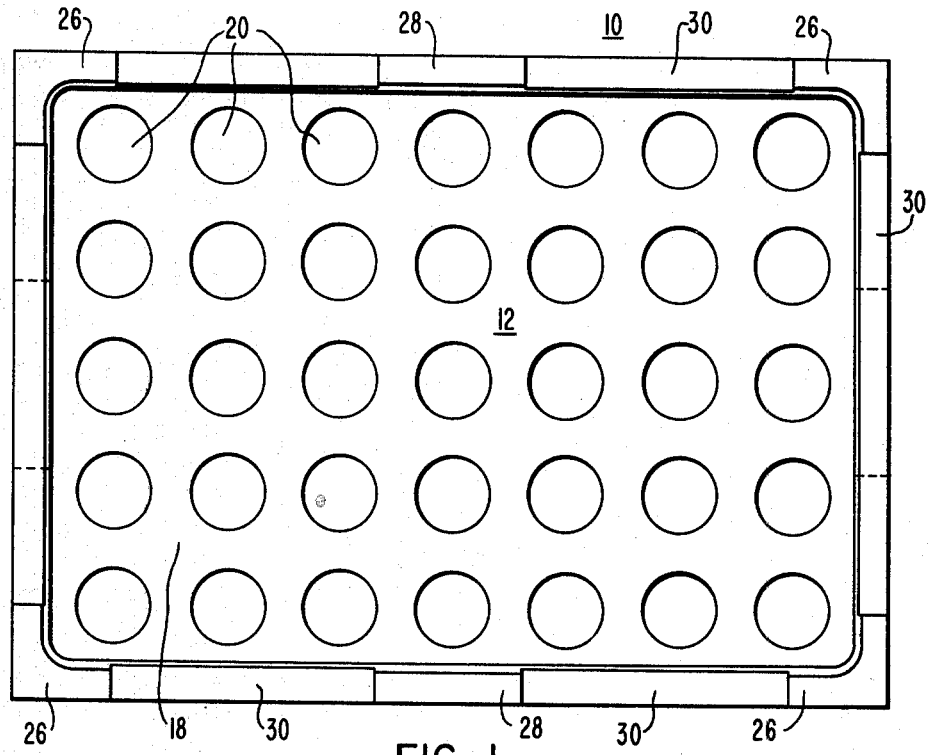
FIG. 1 is a front view with parts broken away and in cross-section of apparatus for supporting a plurality of insulators according to the teachings of the invention.
Figure 2:
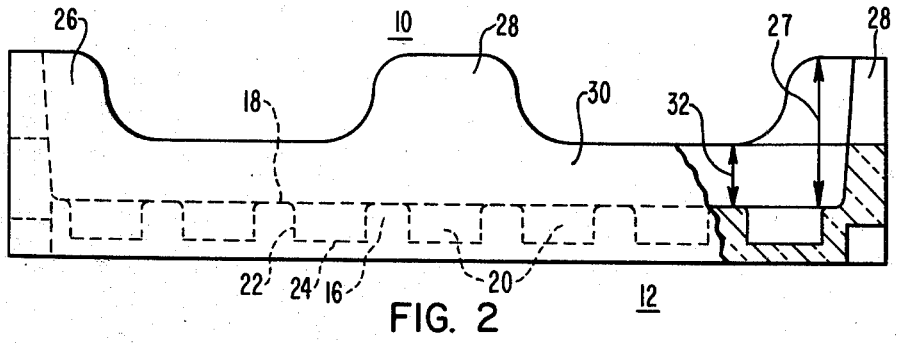
FIG. 2 is a side view with parts broken away and in cross-section of apparatus for supporting a plurality of insulators according to the teachings of the invention.
Figure 3:
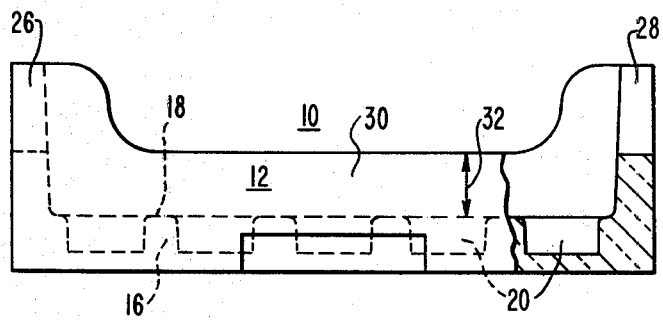
FIG. 3 is a top view, respectively, of apparatus for supporting a plurality of insulators according to the teachings of the invention.

Throughout this description, like elements will be identified with like numerals. Referring now to the drawings and to FIGS. 1, 2 and 3 in particular, there is shown a front, top and side view, respectively, of support apparatus 10 according to the teachings of the invention. Support apparatus 10 includes support means 12 for supporting a plurality of insulators at a predetermined position and spacing means 14 for supporting another support apparatus (not shown). Spacing means 14 is integrally connected to support means 12 so as to provide for stacking a plurality of support apparatus such as support apparatus 10 without the need for setting and leveling fire brick as a spacing means between the insulator support means.

Support means 12 includes a base 16 having a first surface 18 with a plurality of recesses such as recesses 20 disposed therein. Thirty-five recesses are used in the preferred embodiment. Each of the recesses such as recesses 20 includes a lateral portion such as lateral portion 22 and a bottom support portion such as bottom support portion 24. Spacing means 14 includes a sufficient number of integral supports such as corner supports 26 and middle supports 28 for supporting another support apparatus (not shown) so that multiple support apparatus such as support apparatus 10 may be stacked one upon the other in a static arrangement inside a kiln during the firing of the insulators. The rigid support capable in this arrangement also provides for transportation of the stacked insulators and support means en masse without disassembling of the stacks. Supports 26 and 28 project upward a first predetermined distance 27 from the first surface 18 of base 16, said first predetermined distance 27 selected to permit stacking of multiple support apparatus without interfering with the insulators supported thereon. Spacing means 14 further includes an external peripheral wall such as wall 30 which is enclosed upon itself and extends perpendicularly upward a second predetermined distance 32 from the periphery of base 16 to provide for adequate ventilation of the insulators therein, particularly when insulators in the form of greenware are supported within the kiln during the firing thereof. Wall 30 may be made integral with both the periphery of base 16 and supports 26 and 28 to increase the strength of spacing means 14.

Figure 4:
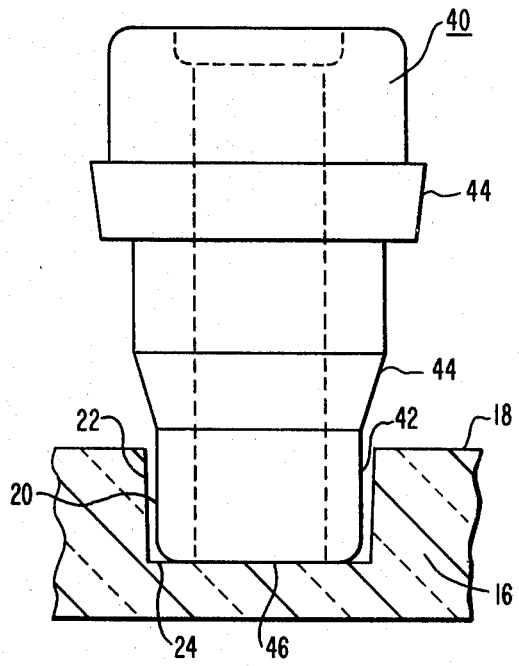
FIG. 4 is an enlarged view in cross-section of a typical recess of the apparatus of FIGS. 1–3 shown supporting a typical insulator.

Referring now to FIG. 4 there is shown a portion of base 16 depicting a typical recess such as recess 20 supporting a typical insulator 40. Insulator 40 is typical of that type of insulator that would be used for small distribution transformer secondary bushings for example. It is not, however, limited to this use, but may be assembled on reactors, circuit breakers, or other electrical apparatus. Insulator 40 includes a mounting portion 42 which may be inserted into an associated mounting flange (not shown) or inserted directly into an opening in a transformer tank (not shown), reactor (not shown), circuit breaker, or other electrical apparatus during the assembly of such apparatus. Insulator 40 further includes flanged portions 44 and a load bearing surface portion 46 which is the bottom surface of mounting portion 42. It is this surface of insulators that the greenware of fired ceramic insulators are supported on during the firing process. Therefore surface 46 is designated the load bearing surface portion of insulator 40 and is supported on bottom support portion 24 of recess 20 with lateral portion 22 of recess 20 providing lateral support for mounting portion 42 of insulator 40 so as to support insulator 40 in the vertical position. Bottom support portion 24 of recess 20 is disposed at a predetermined depth from the first surface 18 of base 16 of support apparatus 10, selected to position insulator 40 so that any flanged portion such as flanged portions 44 is located above the first surface 18 of base 16. This is important because one of the steps before firing in the manufacture of insulators may be the coating of the insulator with glazing compound. By locating the insulator such as insulator 40 within a recess such as recess 20 such that all flanged portions are disposed above the base surface such as first surface 18 of base 16 of support apparatus 10, the glazing coating will not stick to the support apparatus but rather will be allowed to harden into a smooth, unblemished protective coating on the surface of the insulator.

Since both the support means 12 and spacing means 14 of support apparatus 10 are integral with one another as described above, support apparatus 10 would be made of one integral material which would be suitable for withstanding and will be reusable at the end of the firing process. In addition, the material must have the requisite strength for stacking while loaded with insulators. Cordiorite, a high-temperature refractory material made from magnesium, aluminum and silicate, has been used in the preferred embodiment with excellent results. Other refractory materials selected according to the above criteria may also be employed. Support apparatus 10 would be formed of such materials by methods that are well known in the refractory art. The cordiorite support apparatus of the preferred embodiment was formed by pressing out the raw material with a dye and firing at a temperature of approximately 2500° F. for example.

In conclusion, there has been disclosed herein a reusable support apparatus that combines a support means with an integral spacing means to provide a handling device that may be stacked and transported through the various production areas of insulator manufacturing without disturbing the individual insulators supported therein. Secondary support materials normally required for stacking and leveling in the kiln during firing are eliminated. The integral support means provides for sufficient ventilation of the insulator greenware during firing just as with the prior art method of supporting plates spaced by first brick. Although the invention has been described as a material handling device for ceramic insulators, because it was developed to solve certain problems unique to the production of ceramic insulators, it is to be understood the invention is not limited thereto, but rather is broadly applicable as a material handling apparatus for any insulators or other greenware whether they be ceramic, resinous, or other suitable materials. Further, although the description of the preferred embodiment describes apparatus for supporting a plurality of insulators, the invention is not so limited but rather can be applied to embodiments for supporting a single insulator as well as embodiments that would support a number limited only by the size of the kiln and the production facilities.

We claim:

1. Apparatus for supporting ceramic insulator greenware having a mounting portion, a flanged portion and a load bearing surface portion, comprising: support means for supporting said ceramic insulator greenware, said support means including a base having a first surface with at least one recess therein, said recess including a lateral portion and a bottom support portion, said lateral portion providing lateral support for said mounting portion of said ceramic insulator greenware so as to support said ceramic insulator greenware in a predetermined position, said bottom support portion of said recess providing a support surface for said load bearing surface of said ceramic insulator greenware, said recess having a predetermined depth from said first surface of said base selected to position said ceramic insulator greenware so that said flanged portion of said ceramic insulator greenware is above said first surface of said base.

2. The apparatus of claim 1 further including a spacing means integrally connected to said support means for supporting another support means, said spacing means including integral supports projecting upward a first predetermined distance from the periphery of said base, said predetermined distance being selected and said integral supports being positioned such that multiple apparatus for supporting ceramic insulator greenware may be stacked one upon the other without interfering with said ceramic insulator greenware.

3. The apparatus of claim 2 wherein the base has a rectangular shape and the integral spacing means includes at least four integral supports, one of said integral supports projecting upward from each corner of said rectangular base.

4. The apparatus of claim 3 wherein the integral spacing means includes two additional integral supports, each of said additional integral supports projecting upward from the middle of opposite sides of the periphery of said rectangular base.

5. The apparatus of claim 4 wherein the spacing means further includes an external peripheral wall enclosed upon itself extending perpendicularly upward a second predetermined distance from the periphery of said base selected to increase the strength of the spacing means and to provide a protective wall around the at least one insulator.

6. The apparatus of claim 5 wherein the second predetermined distance is less than the first predetermined distance, selected to provide adequate ventilation of the at least one insulator contained within the apparatus.

7. The apparatus of claim 6 wherein the external peripheral wall is integral with both the base and the supports to increase the strength of the spacing means.

8. The apparatus of claim 1 wherein the predetermined position is the vertical position.

9. The apparatus of claim 1 wherein said base surface has a plurality of recesses thereon for supporting a plurality of ceramic insulators.

10. The apparatus of claim 1 wherein said base surface has thirty-five recesses therein for supporting thirty-five ceramic insulators.

11. The apparatus of claim 2 wherein the support means and the spacing means are one integral unit made from cordiorite refractory material.

* * * * *